US010582728B2

(12) United States Patent
Liu

(10) Patent No.: US 10,582,728 B2
(45) Date of Patent: Mar. 10, 2020

(54) ELECTRONIC CIGARETTE HAVING A RELATIVELY LARGE POWER

(71) Applicant: Tuanfang Liu, Ji'an (CN)

(72) Inventor: Tuanfang Liu, Ji'an (CN)

( * ) Notice: Subject to any disclaimer, the term of this patent is extended or adjusted under 35 U.S.C. 154(b) by 201 days.

(21) Appl. No.: 15/829,967

(22) Filed: Dec. 3, 2017

(65) Prior Publication Data

US 2019/0037922 A1 Feb. 7, 2019

(30) Foreign Application Priority Data

Aug. 2, 2017 (CN) ..... 2017 2 0954905 U

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 47/00*** | (2020.01) |
| ***H05B 3/03*** | (2006.01) |
| ***H05B 3/04*** | (2006.01) |
| ***H05B 3/44*** | (2006.01) |

(52) U.S. Cl.

CPC ..... *A24F 47/008* (2013.01); *H05B 3/03* (2013.01); *H05B 3/04* (2013.01); *H05B 3/44* (2013.01); *H05B 2203/005* (2013.01); *H05B 2203/021* (2013.01)

(58) Field of Classification Search

CPC ..... A24F 47/008; A24F 47/002; H05B 3/03; H05B 3/04; H05B 3/44

USPC ..... 131/329, 328

See application file for complete search history.

(56) References Cited

U.S. PATENT DOCUMENTS

| | | | | |
|---|---|---|---|---|
| 10,028,532 | B2 * | 7/2018 | Zhu | A24F 47/008 |
| 2015/0305403 | A1 * | 10/2015 | Coelho Belo Fernandes De Carvalho | F22B 1/284 131/328 |
| 2015/0374039 | A1 * | 12/2015 | Zhu | A24F 47/008 131/329 |
| 2016/0000145 | A1 * | 1/2016 | Liu | A61M 15/06 131/329 |
| 2016/0295920 | A1 * | 10/2016 | Liu | H05B 3/0014 |
| 2017/0013881 | A1 * | 1/2017 | Liu | A24F 47/008 |
| 2017/0354182 | A1 * | 12/2017 | Liu | A24F 47/008 |
| 2018/0027874 | A1 * | 2/2018 | Zhu | A24F 47/008 |
| 2019/0069598 | A1 * | 3/2019 | Liu | A24F 47/008 |
| 2019/0142069 | A1 * | 5/2019 | Qiu | A24F 47/008 131/329 |

* cited by examiner

*Primary Examiner* — Hae Moon Hyeon

(74) *Attorney, Agent, or Firm* — Matthias Scholl P.C.; Matthias Scholl

(57) ABSTRACT

An electronic cigarette including an atomizing core assembly; a mouthpiece assembly; a base assembly; and a housing assembly. The atomizing core assembly includes a first heating wire, a second heating wire, a third heating wire, a fourth heating wire, a fifth heating wire, a housing for accommodating heating wires, a seal ring for sealing the heating wires, a pedestal for holding the heating wires, an insulation ring, and a first joint adapted for squeezing the housing of the heating wire. The mouthpiece assembly includes a cigarette holder, a first sealing ring, a second sealing ring, a base for holding the cigarette holder, a third sealing ring, and a fourth sealing ring. The base assembly includes a glass tube, a first lower sealing ring, a second lower sealing ring, a support for supporting the glass tube, a regulation ring, a sealing ring, a second insulation ring, and a second joint.

1 Claim, 7 Drawing Sheets

ELECTRONIC CIGARETTE HAVING A RELATIVELY LARGE POWER

CROSS-REFERENCE TO RELATED APPLICATIONS

Pursuant to 35 U.S.C. § 119 and the Paris Convention Treaty, this application claims foreign priority to Chinese Patent Application No. 201720954905.1 filed Aug. 2, 2017, the contents of which and any intervening amendments thereto are incorporated herein by reference.

BACKGROUND OF THE INVENTION

Field of the Invention

The invention relates to an electronic cigarette.

Description of the Related Art

It is well-known that smoking is harmful to health, but there are still over a billion of smokers in the world. Despite declines in smoking rates, number of smokers and cigarettes continues to rise. To purify the environment, prohibition of smoking in public places has become the consensus. Thus, cigarette substitutes, such as patches for quitting smoking, nicotine mouthwash, nicotine gum, nicotine drink, flourish in the market.

Although the cigarette substitutes are a step in the right direction as they do not deliver tar, nicotine is only slowly absorbed in the blood and thus the achieved effective peak concentration of nicotine is relatively low and the feeling of satisfaction resulting from a high concentration of tobacco alkali is not achieved. Meanwhile, users consuming cigarette substitutes are deprived of smoking actions such as inhaling, exhaling, and puffing.

Conventional electronic cigarettes include only one heating wire, leading to relatively low power and small amount of aerosol (vapor). In addition, the e-liquid is loaded from the bottom of the electronic cigarettes, which creates the risk of leakage.

SUMMARY OF THE INVENTION

In view of the above-described problems, it is one objective of the invention to provide an electronic cigarette that has a relatively large power and can produce a relatively large amount of aerosol (vapor), and the e-liquid is loaded from the top of the electronic cigarette.

To achieve the above objective, in accordance with one embodiment of the invention, there is provided an electronic cigarette, comprising an atomizing core assembly, a mouthpiece assembly, a base assembly, and a housing assembly.

The atomizing core assembly comprises a first heating wire, a second heating wire, a third heating wire, a fourth heating wire, a fifth heating wire, a housing for accommodating heating wires, a seal ring for sealing the heating wires, a pedestal for holding the heating wires, a first insulation ring, and a first joint adapted for squeezing the housing of the heating wires; the first heating wire, the second heating wire, the third heating wire, the fourth heating wire, and the fifth heating wire are all sleeved with a cotton wool and then are disposed in the pedestal; the first insulation ring is disposed in the pedestal to separate cathodes and anodes of the heating wires; the first joint is inserted in an inner ring of the first insulation ring and presses the housing on the pedestal; and the seal ring is disposed on the bottom of the pedestal. The combination of the first heating wire, the second heating wire, the third heating wire, the fourth heating wire, and the fifth heating wire ensures a large amount vapor can be produced, and through appropriately controlling the air flow, users can enjoy good user experience.

The mouthpiece assembly comprises a cigarette holder, a first sealing ring and a second sealing ring for sealing the cigarette holder, a base for holding the cigarette holder, a third sealing ring disposed below the base, and a fourth sealing ring disposed in the base which are assembled with one another in that order. The cigarette holder is made of environmental copolyester material and has a large opening, thus avoiding the burning of user's mouth due to high-temperature caused by a mass of non-flowing vapor. The first sealing ring and the second sealing ring are embedded in upper and lower grooves of the base, the cigarette holder is fixed on the base, the third sealing ring is disposed below the base, and the fourth sealing ring is disposed in the base, to form an integrated structure with good sealing properties, preventing the leakage of the e-liquid.

The base assembly comprises a glass tube, a first lower sealing ring and a second lower sealing ring for sealing the glass tube, a support for supporting the glass tube, a regulation ring, a sealing ring of the regulation ring, a second insulation ring, and a second joint. The glass tube, the first lower sealing ring, the second lower sealing ring, and the support are tightly fit, thus preventing the leakage of e-liquid. The second joint and the second insulation ring are assembled and inserted into the support, which separates the cathode and the anode of the electronic cigarette and prevents the short circuit. The regulation ring and the sealing ring of the regulation ring are fixed on the support, which improves the sealing properties and can control the vapor amount through regulating the gas flow.

The housing assembly comprises a connecting pipe, a lower sealing ring for sealing the connecting pipe, an upper sealing ring for sealing the glass tube, and a shell. The shell and the connecting pipe are detachably assembled, which simplifies the assembling process. The lower sealing ring of the connecting pipe and the upper sealing ring of the glass tube are synchronously inserted in and fixed on the connecting pipe, thus improving the sealing properties and preventing the leakage of e-liquid.

Advantages of the electronic cigarette according to embodiments of the present disclosure are summarized as follows. The electronic cigarette has a relatively large power and can produce a relatively large amount of aerosol (vapor), and has high sealing properties.

BRIEF DESCRIPTION OF THE DRAWINGS

The invention is described hereinbelow with reference to accompanying drawings, in which.

DETAILED DESCRIPTION OF THE EMBODIMENTS

Figure 1:
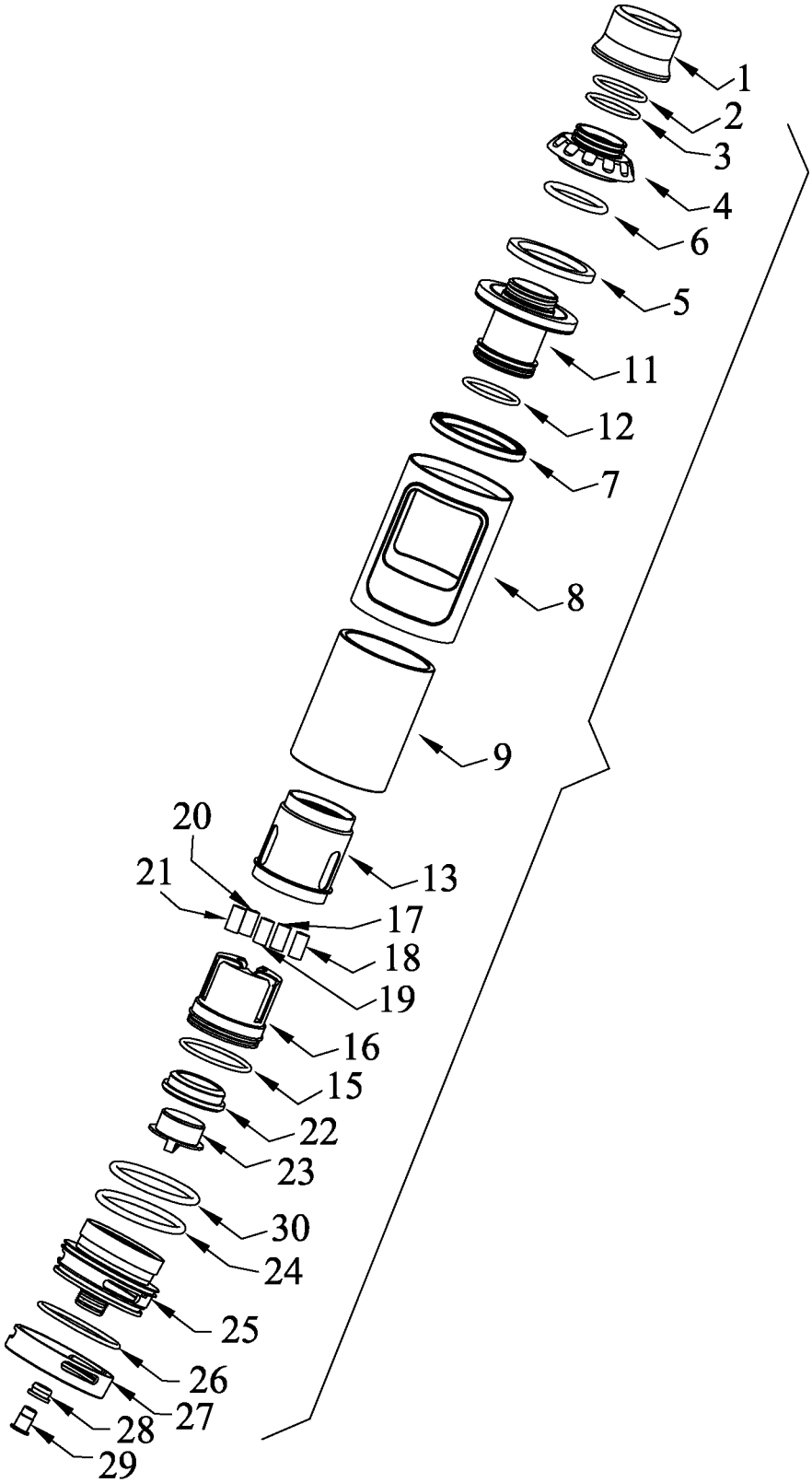
FIG. 1 is an exploded view of an electronic cigarette in accordance with one embodiment of the invention
Figure 2:
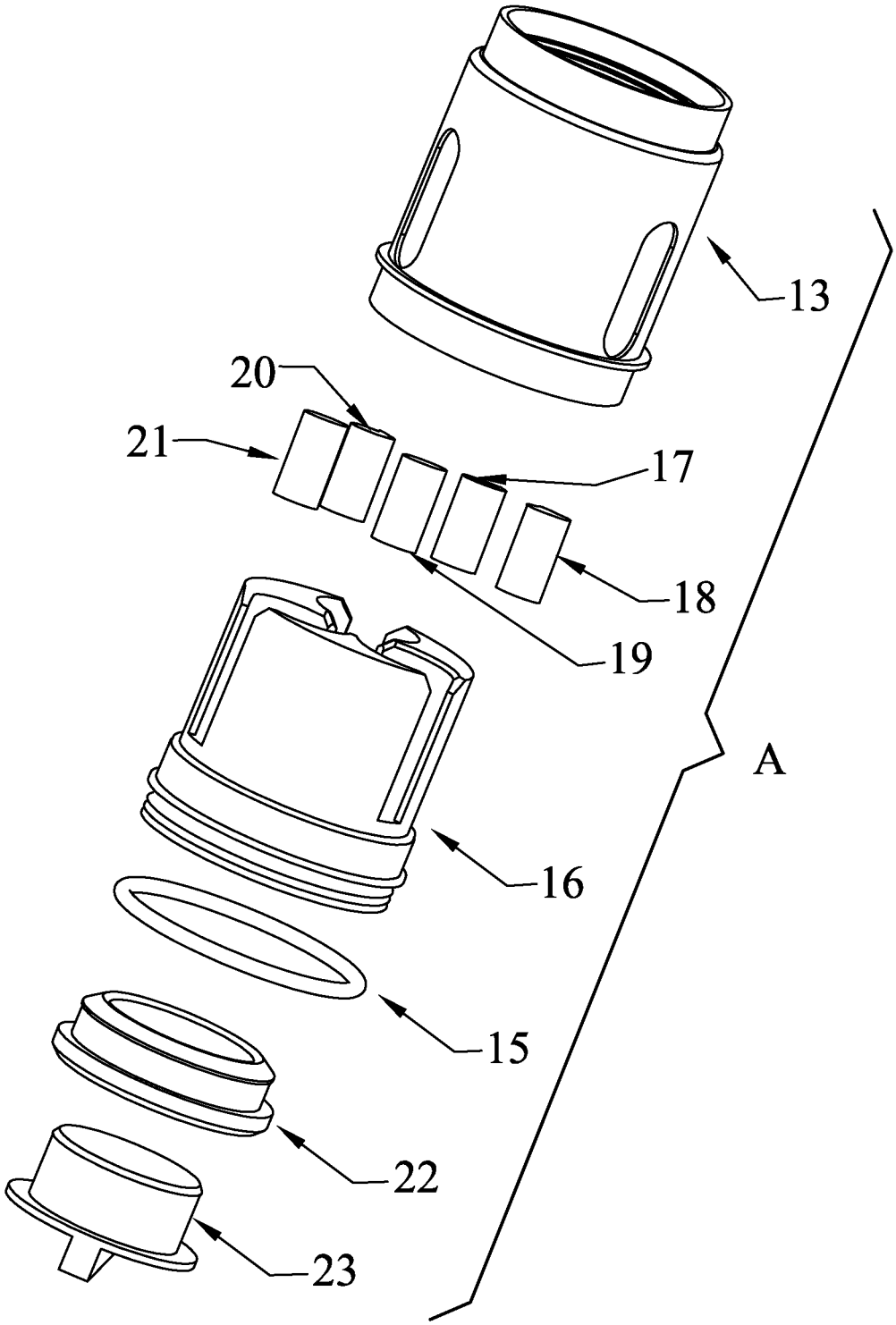
FIG. 2 is a schematic diagram of an atomizing core assembly of an electronic cigarette in accordance with one embodiment of the invention.
Figure 3:
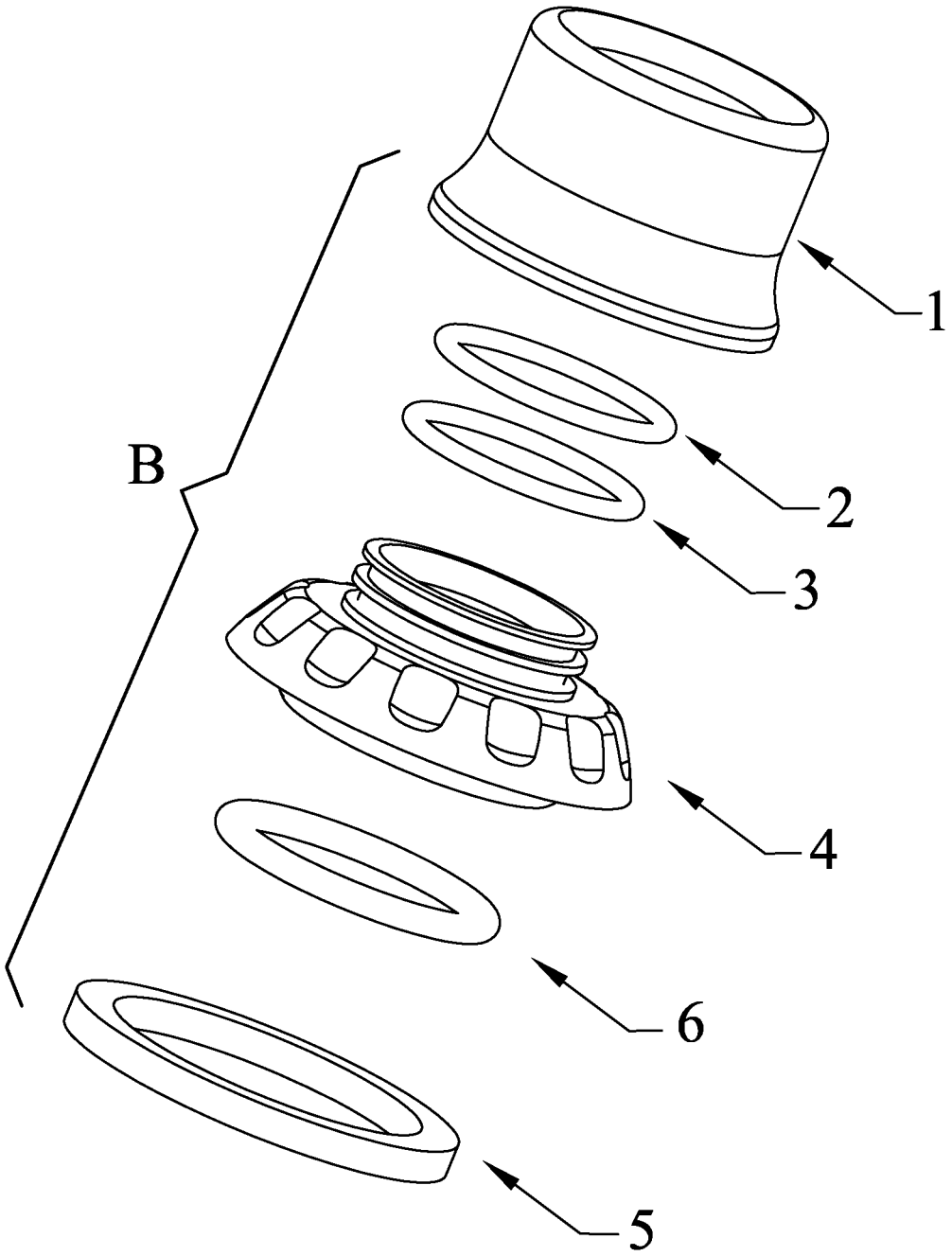
FIG. 3 is a schematic diagram of a mouthpiece assembly of an electronic cigarette in accordance with one embodiment of the invention.
Figure 4:
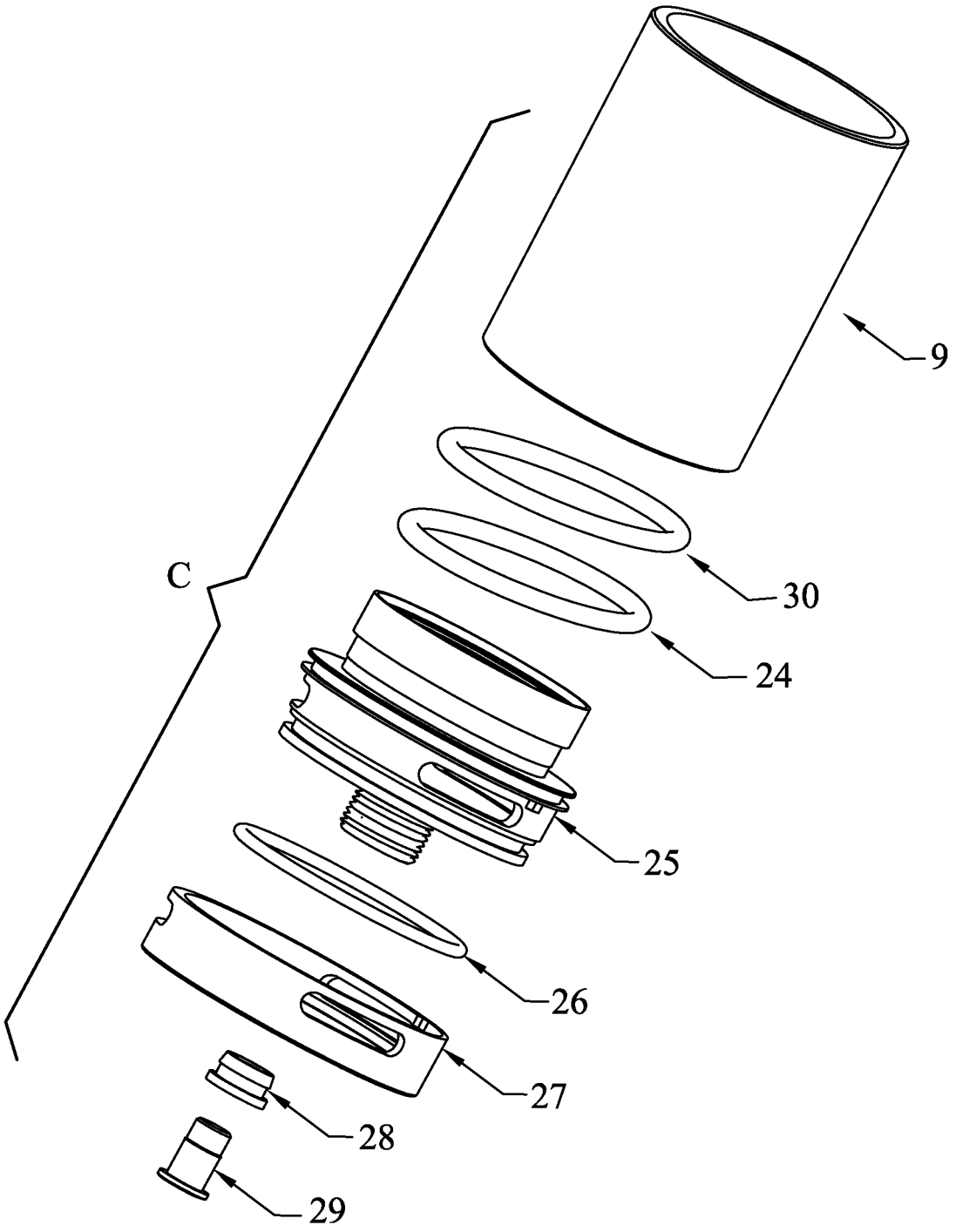
FIG. 4 is a schematic diagram of a base assembly of an electronic cigarette in accordance with one embodiment of the invention.
Figure 5:
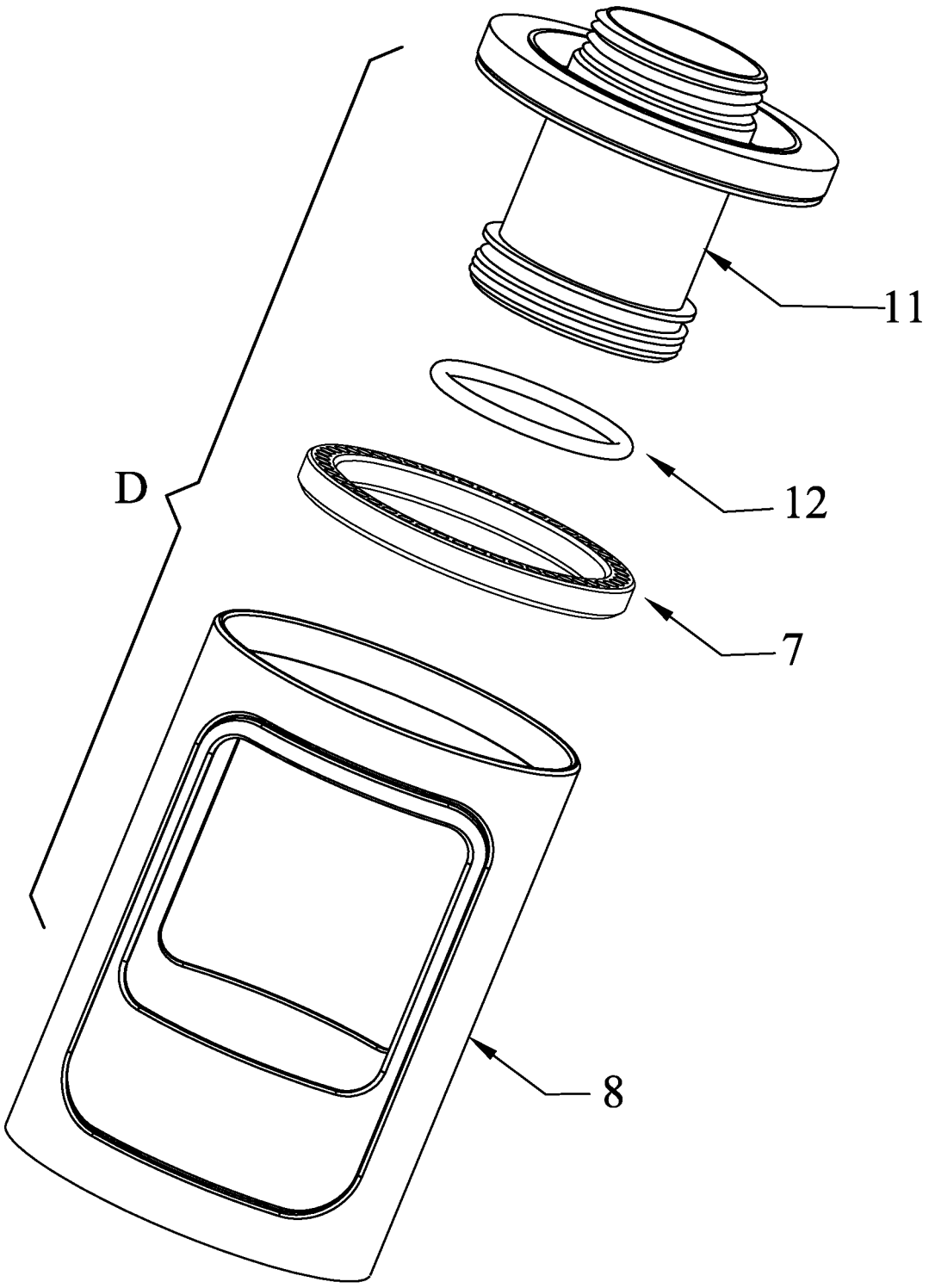
FIG. 5 is a schematic diagram of a housing assembly of an electronic cigarette in accordance with one embodiment of the invention.
Figure 6:
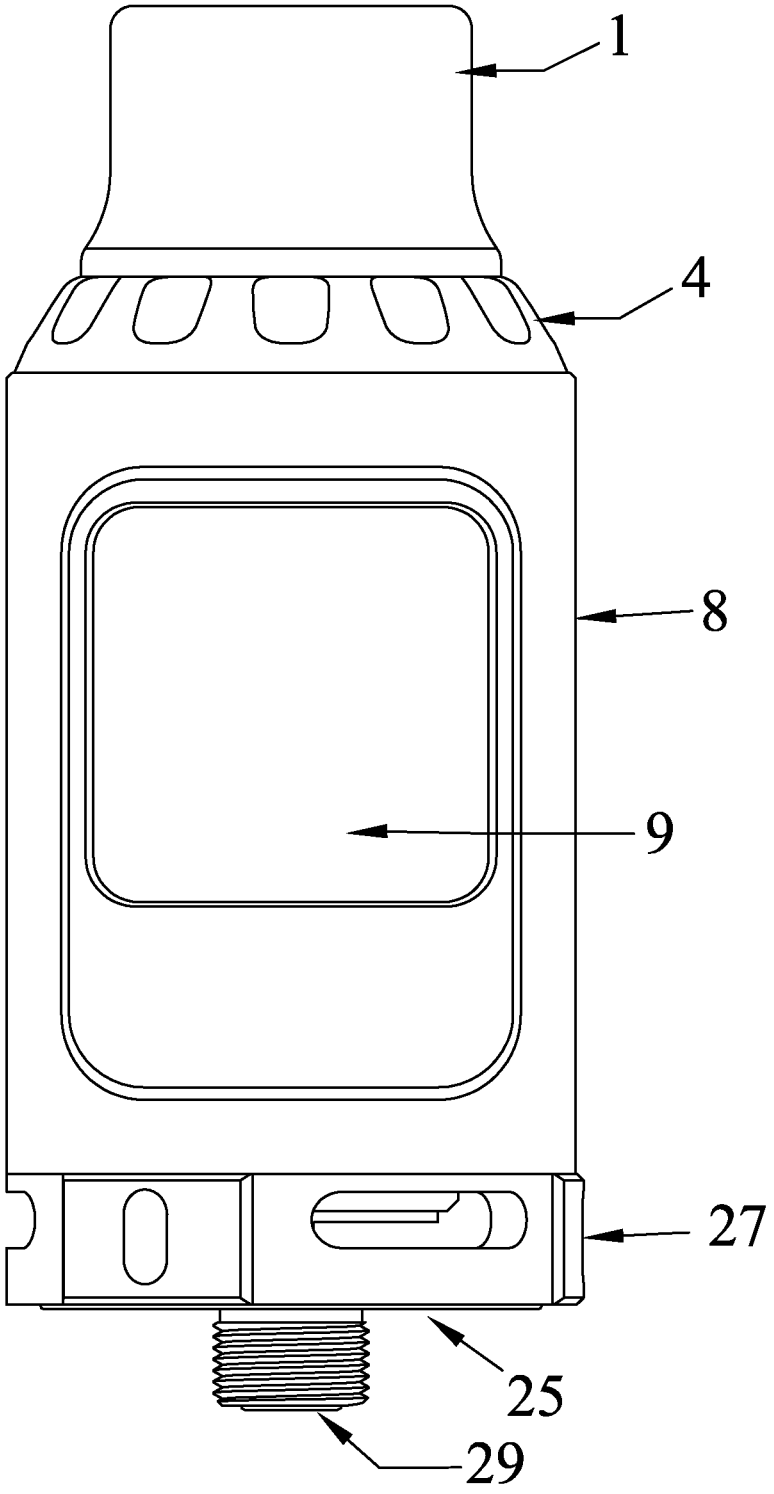
FIG. 6 is a stereogram of an electronic cigarette in accordance with one embodiment of the invention.
Figure 7:
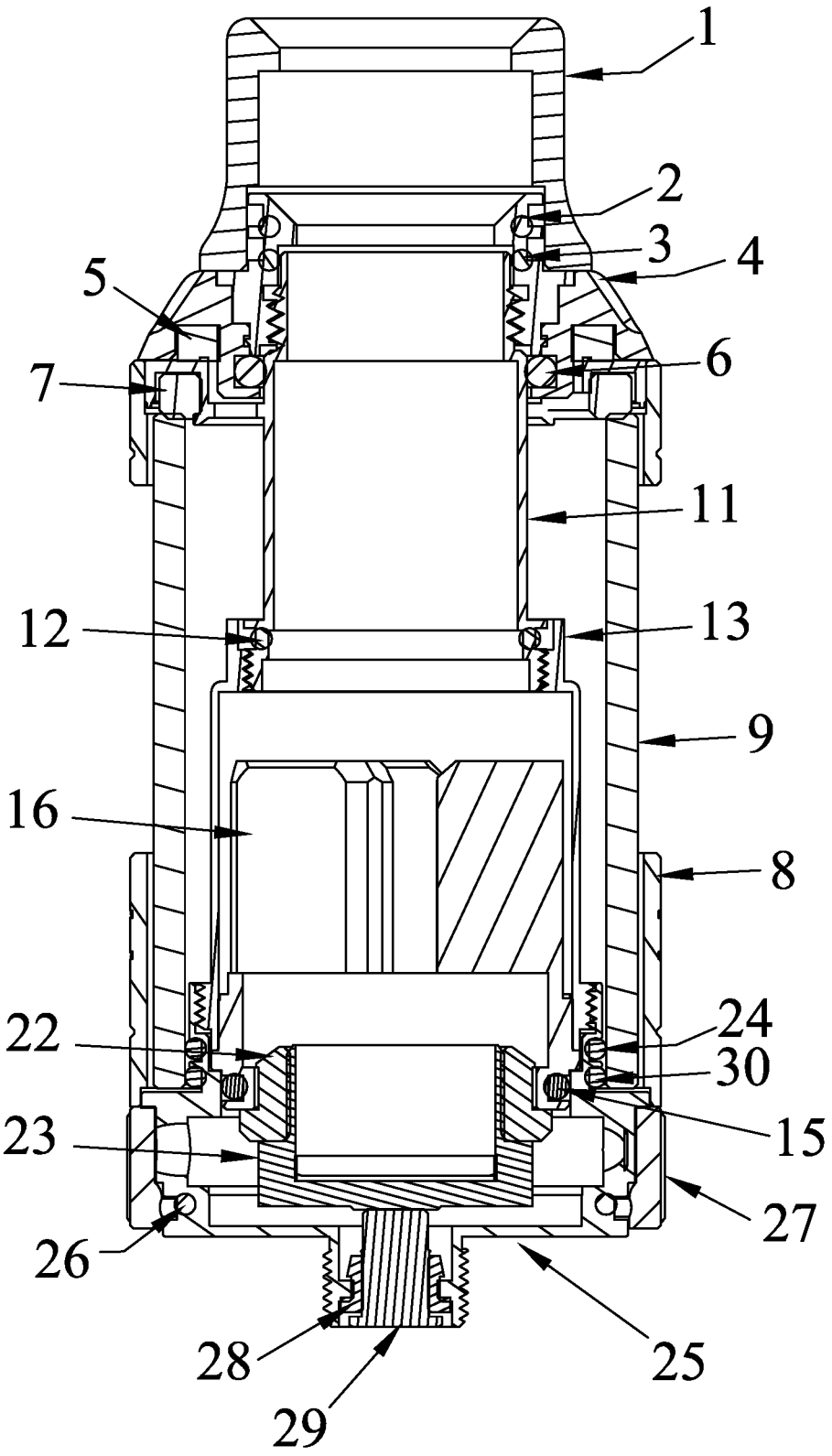
FIG. 7 is a sectional view of an electronic cigarette in accordance with one embodiment of the invention.

The invention is described in detail combined with the drawings. As shown in FIGS. 1-6, an electronic cigarette of the invention comprises an atomizing core assembly A, a mouthpiece assembly B, a base assembly C, and a housing assembly D.

The atomizing core assembly A comprises a first heating wire 17, a second heating wire 18, a third heating wire 19, a fourth heating wire 20, a fifth heating wire 21, a housing 13 for accommodating heating wires, a seal ring 15 for sealing the heating wires, a pedestal 16 for holding the heating wires, a first insulation ring 22, and a first joint 23 adapted for squeezing the housing of the heating wires. The first heating wire 17, the second heating wire 18, the third heating wire 19, the fourth heating wire 20, and the fifth heating wire 21 are all sleeved with a cotton wool and then are disposed in the pedestal 16. The first insulation ring 22 is disposed in the pedestal 16 to separate cathodes and anodes of the heating wires; the first joint 23 is inserted in an inner ring of the first insulation ring 22 and presses the housing 13 on the pedestal 16; and the seal ring 15 is disposed on the bottom of the pedestal 16. The combination of the first heating wire 17, the second heating wire 18, the third heating wire 19, the fourth heating wire 20, and the fifth heating wire 21 ensures a large amount vapor can be produced, and through appropriately controlling the air flow, users can enjoy good user experience.

The mouthpiece assembly B comprises a cigarette holder 1, a first sealing ring 2 and a second sealing ring 3 for sealing the cigarette holder, a base 4 for holding the cigarette holder, a third sealing ring 5 disposed below the base, and a fourth sealing ring 6 disposed in the base which are assembled with one another in that order. The first sealing ring 2 and the second sealing ring 3 are embedded in upper and lower grooves of the base, the cigarette holder 1 is fixed on the base, the third sealing ring 5 is disposed below the base, and the fourth sealing ring 6 is disposed in the base, to form an integrated structure with good sealing properties, preventing the leakage of the e-liquid. Thereafter, the cigarette holder is fixed on the base 4 and sleeved with glass. The cigarette holder 1 is made of environmental copolyester material and has a large opening, thus avoiding the burning of user's mouth due to high-temperature caused by a mass of non-flowing vapor. The assembly of the cigarette holder 1, the first sealing ring 2, the second sealing ring 3, the base 4 for holding the cigarette holder, the third sealing ring 5, and the fourth sealing ring 6 is simple, and the sealing properties of the assembled structure is good, preventing the leakage of e-liquid.

The base assembly C comprises a glass tube 9, a first lower sealing ring 24 and a second lower sealing ring 30 for sealing the glass tube, a support 25 for supporting the glass tube 9, a regulation ring 27, a sealing ring 26 of the regulation ring, a second insulation ring 28, and a second joint 29. The glass tube 9, the first lower sealing ring 24, the second lower sealing ring 30, and the support 25 are tightly fit, thus preventing the leakage of e-liquid. The second joint 29 and the second insulation ring 28 are assembled and inserted into the support 25, which separates the cathode and the anode of the electronic cigarette and prevents the short circuit. The regulation ring 27 and the sealing ring 26 of the regulation ring are fixed on the support 25, which improves the sealing properties and can control the vapor amount through regulating the gas flow.

The housing assembly D comprises a connecting pipe 11, a lower sealing ring 12 for sealing the connecting pipe, an upper sealing ring 7 for sealing the glass tube, and a shell 8. The shell and the connecting pipe are detachably assembled, which simplifies the assembling process. The lower sealing ring 12 of the connecting pipe and the upper sealing ring 7 of the glass tube are synchronously inserted in and fixed on the connecting pipe 11, thus improving the sealing properties and preventing the leakage of e-liquid.

The electronic cigarette of the invention comprises a plurality of vertically disposed heating wires made of iron-chromium material. The e-liquid guiding cotton is environmental organic cotton, which can produce much vapor and brings about good user experience. The pedestal, sealing rings, and glass housing are tightly assembled to form a stable structure with good sealing properties, and the vapor amount can be adjusted by controlling the regulation ring. The cigarette holder is made of environmental acrylic material and has a large opening, which avoids the burning of user's mouth due to high-temperature caused by a mass of non-flowing e-liquid. The assembling and disassembling process of the mouthpiece assembly is easy, the e-liquid can be conveniently injected from the top of the electronic cigarette, improving the production efficiency.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An electronic cigarette, comprising:

an atomizing core assembly;

a mouthpiece assembly;

a base assembly; and a housing assembly;

wherein:

the atomizing core assembly comprises a first heating wire, a second heating wire, a third heating wire, a fourth heating wire, a fifth heating wire, a housing for accommodating heating wires, a seal ring for sealing the heating wires, a pedestal for holding the heating wires, an insulation ring, and a first joint; the first heating wire, the second heating wire, the third heating wire, the fourth heating wire, and the fifth heating wire are all sleeved with a cotton wool and then are disposed in the pedestal; the insulation ring is disposed in the pedestal; the first joint is inserted in the insulation ring and presses the insulation ring on the pedestal; and the seal ring is disposed on a bottom of the pedestal;

the mouthpiece assembly comprises a cigarette holder, a first sealing ring and a second sealing ring for sealing the cigarette holder, a base for holding the cigarette holder, a third sealing ring disposed below the base, and a fourth sealing ring disposed in the base which are assembled with one another in that order; the cigarette holder is made of environmental acrylic material; the first sealing ring and the second sealing ring are embedded in upper and lower grooves of the base, the cigarette holder is fixed on the base, the third sealing ring is disposed below the base, and the fourth sealing ring is disposed in the base;

the base assembly comprises a glass tube, a first lower sealing ring and a second lower sealing ring for sealing the glass tube, a support for supporting the glass tube, a regulation ring, a sealing ring of the regulation ring, a second insulation ring, and a second joint; the glass tube, the first lower sealing ring, the second lower sealing ring, and the support are tightly fit; the second joint and the second insulation ring are assembled and inserted into the support; the regulation ring and the sealing ring of the regulation ring are fixed on the support;

the housing assembly comprises a connecting pipe, a lower sealing ring disposed in the connecting pipe, an upper sealing ring disposed in the connecting pipe; and a shell; the shell and the connecting pipe are detachably assembled;

the atomizing core assembly is disposed in and supported by the base assembly, wherein the atomizing core assembly is disposed in the glass tube of the base assembly, and the first joint of the atomizing core assembly abuts against the second joint of the base assembly;

the mouthpiece assembly is connected to the atomizing core assembly via the housing assembly, wherein the base of the mouthpiece assembly is connected to the housing of the atomizing core assembly via the connecting pipe of the housing assembly; and the shell of the housing assembly is disposed outside the glass tube of the base assembly and abuts against the support of the base assembly.

* * * * *